US009748065B2

(12) United States Patent
Shima et al.

(10) Patent No.: US 9,748,065 B2
(45) Date of Patent: Aug. 29, 2017

(54) SEALED CONTACT DEVICE

(71) Applicant: OMRON Corporation, Kyoto-shi, Kyoto (JP)

(72) Inventors: Hiromi Shima, Kumamoto (JP); Masaki Mori, Kumamoto (JP); Takuma Okamoto, Kumamoto (JP)

(73) Assignee: OMRON Corporation, Kyoto (JP)

( * ) Notice: Subject to any disclaimer, the term of this patent is extended or adjusted under 35 U.S.C. 154(b) by 180 days.

(21) Appl. No.: 14/426,699

(22) PCT Filed: Aug. 8, 2014

(86) PCT No.: PCT/JP2014/071071
§ 371 (c)(1),
(2) Date: Mar. 6, 2015

(87) PCT Pub. No.: WO2015/136731
PCT Pub. Date: Sep. 17, 2015

(65) Prior Publication Data

US 2016/0260566 A1 Sep. 8, 2016

(30) Foreign Application Priority Data

Mar. 14, 2014 (JP) ..... 2014-052386

(51) Int. Cl.
*H01H 50/38* (2006.01)
*H01H 9/44* (2006.01)
(Continued)

(52) U.S. Cl.
CPC ..... *H01H 50/38* (2013.01); *H01H 9/443* (2013.01); *H01H 50/023* (2013.01);
(Continued)

(58) Field of Classification Search
CPC ..... H01H 9/443; H01H 50/38; H01H 50/546
See application file for complete search history.

(56) References Cited

U.S. PATENT DOCUMENTS

2013/0240495 A1* 9/2013 Yano ..... H01H 9/36 219/123

FOREIGN PATENT DOCUMENTS

| | | | |
|---|---|---|---|
| EP | 2218086 | A1 | 8/2010 |
| EP | 2 639 804 | A1 | 9/2013 |
| JP | 2013-232290 | A | 11/2013 |

OTHER PUBLICATIONS

Extended European Search Report in counterpart European Application No. 14 83 8831.7 issued Feb. 9, 2016 (7 pages).
(Continued)

*Primary Examiner* — Ramon M Barrera
(74) *Attorney, Agent, or Firm* — Osha Liang LLP

(57) ABSTRACT

A sealed contact device capable of maintaining a function for drawing a generated arc to disappear rapidly and reliably for a long period. An electromagnetic relay includes a housing, a stationary contact and a moving contact which are disposed opposite to each other in the housing, and a pair of permanent magnets and disposed opposite to the stationary contact and the moving contact. An arc generated between the stationary contact and the moving contact is drawn due to a current conducting between the stationary contact and the moving contact and magnetic forces of the permanent magnets. An arc shield member is disposed in a position in which an arc in the housing is induced.

12 Claims, 12 Drawing Sheets

(51) Int. Cl.

| | |
|---|---|
| ***H01H 51/29*** | (2006.01) |
| ***H01H 50/02*** | (2006.01) |
| *H01H 50/54* | (2006.01) |

(52) U.S. Cl.
CPC ..... *H01H 50/54* (2013.01); *H01H 51/29* (2013.01); *H01H 50/546* (2013.01)

(56) References Cited

OTHER PUBLICATIONS

International Search Report issued in corresponding application No. PCT/JP2014/071071, mailed Sep. 16, 2014 (3 pages).
Written Opinion issued in corresponding application No. PCT/JP2014/071071, mailed Sep. 16, 2014 (3 pages).

* cited by examiner

SEALED CONTACT DEVICE

TECHNICAL FIELD

One or more embodiments of the present invention relate to a sealed contact device and more particularly to a power loading electromagnetic relay capable of dissipating a generated arc rapidly.

BACKGROUND ART

As a sealed contact device, conventionally, there is disclosed a hermetically sealed electromagnetic relay in which a moving shaft 44 to be reciprocated in an axial center direction based on magnetization and demagnetization of a solenoid 20 reciprocates a contact delivering member 28 having a pair of moving contacts 32 and 32 mounted thereon, thereby causing the moving contacts 32 to connect/disconnect from a stationary contact 34 (see Patent Document 1).

Referring to the hermetically sealed electromagnetic relay, a pair of permanent magnets 30 is disposed on an outer peripheral surface of a resin container 26 in order to induce an arc generated between the moving contact 32 and the stationary contacts 34.

PRIOR ART DOCUMENTS

Patent Documents

Patent Document 1: EP2218086B1

SUMMARY OF THE INVENTION

With the electromagnetic relay, however, the arc generated between the moving contacts 32 and the stationary contacts 34 impinges onto an inner peripheral surface of the container 26 so that the container 26 is damaged, and furthermore, the arc heats and rapidly cools a permanent magnet 30, resulting in deterioration in a magnetic characteristic of the permanent magnet 30. In some circumstances efficient dissipation of the arc cannot be maintained for a long period.

One or more embodiments of the present invention provide a sealed contact device capable of maintaining, for a long period, a function for dissipating a generated arc rapidly and reliably.

A sealed contact device according to one or more embodiments of the present invention includes a housing, a stationary contact and a moving contact which are disposed opposite to each other in the housing, and a pair of permanent magnets disposed each opposite to the stationary contact and the moving contact, and has such a structure that an arc generated between the stationary contact and the moving contact is drawn due to a current conducting between the stationary contact and the moving contact and a magnetic force of the permanent magnet, and an arc shield member is disposed in a position in which an arc in the housing is drawn.

According to one or more embodiments of the present invention, even if an arc is generated in any directions, the arc is guided or drawn in a direction due to a current and a magnetic force so that the arc impinges onto and dissipates in the shield member. Therefore, it is possible to prevent deterioration in the magnetic characteristics of the permanent magnet as well as the housing, thereby maintaining a function to dissipate the arc rapidly and reliably for a long period.

As one or more embodiments of the present invention, the arc shield member may be disposed in a direction perpendicular both to a conducting direction of the stationary contact and the moving contacts and to a magnetic force of the permanent magnet disposed in a direction perpendicular to the conducting direction, and may be provided to cover a part of opposing surfaces of the permanent magnets.

According to one or more embodiments, an arc generated between the stationary contact and the moving contact tends to be drawn to the arc shield member before reaching onto the permanent magnet so as to dissipate the arc efficiently.

According to one or more other embodiments of the present invention, the arc shield member may have a gate type section including a plate-shaped coupling member and arm portions formed by bending both ends of the coupling member in a substantially perpendicular manner.

According to one or more embodiments, even if a direction of a current or a magnetic field is changed so that a direction of generation of an arc is varied, the arc impinges onto one of the arm portions of the arc shield member to be dissipated.

Forming the arc shield member into the gate type section facilitates it to be held and access for assembly within an internal space thereof.

According to one or more embodiments of the present invention, at least one arc receiving piece may be provided on at least one of edge parts of the coupling member and the arm portion in the arc shield member.

According to one or more embodiments, the arc likely be drawn onto the arc receiving piece so as to dissipate the arc even more efficiently.

According to one or more embodiments of the present invention, an upper rib may be extended laterally from at least one of upper edge parts of the pair of arm portions.

According to one or more embodiments, an arc generated between the stationary contact and the moving contact impinges onto the upper rib extending from the upper edge part of the arm portion and thus dissipates, thereby preventing the arc from leaking out.

According to one or more embodiments of the present invention, outward ribs may be extended to approach each other from outer edge parts of the pair of arm portions.

According to one or more embodiments, it is possible to inhibit the arc from impinging onto the permanent magnet without interfering a switching operation between the stationary contact and the moving contact. Consequently, it is possible to prevent the magnetic characteristic of the permanent magnet from being deteriorated.

According to one or more embodiments of the present invention, a partition wall including a magnetic flux hole may be bridged between outer edge parts of the pair of arm portions.

According to one or more embodiments, it is possible to dissipate the arc efficiently while ensuring a mechanical strength of the arc shield member.

According to one or more embodiments of the present invention, a partition wall including a cut-out portion may be bridged between outer edge parts of the pair of arm portions.

According to one or more embodiments, it is possible to dissipate the arc efficiently while ensuring a mechanical strength of the arc shield member.

According to one or more embodiments of the present invention, a partition wall including at least one slit may be bridged between outer edge parts of the pair of arm portions.

According to one or more embodiments, it is possible to dissipate the arc efficiently while ensuring a mechanical strength of the arc shield member.

DETAILED DESCRIPTION

One or more embodiments in which a sealed contact device according to the present invention is applied to a hermetically sealed electromagnetic relay will be described with reference to the accompanying drawings of FIGS. 1 to 12.

Figure 6:
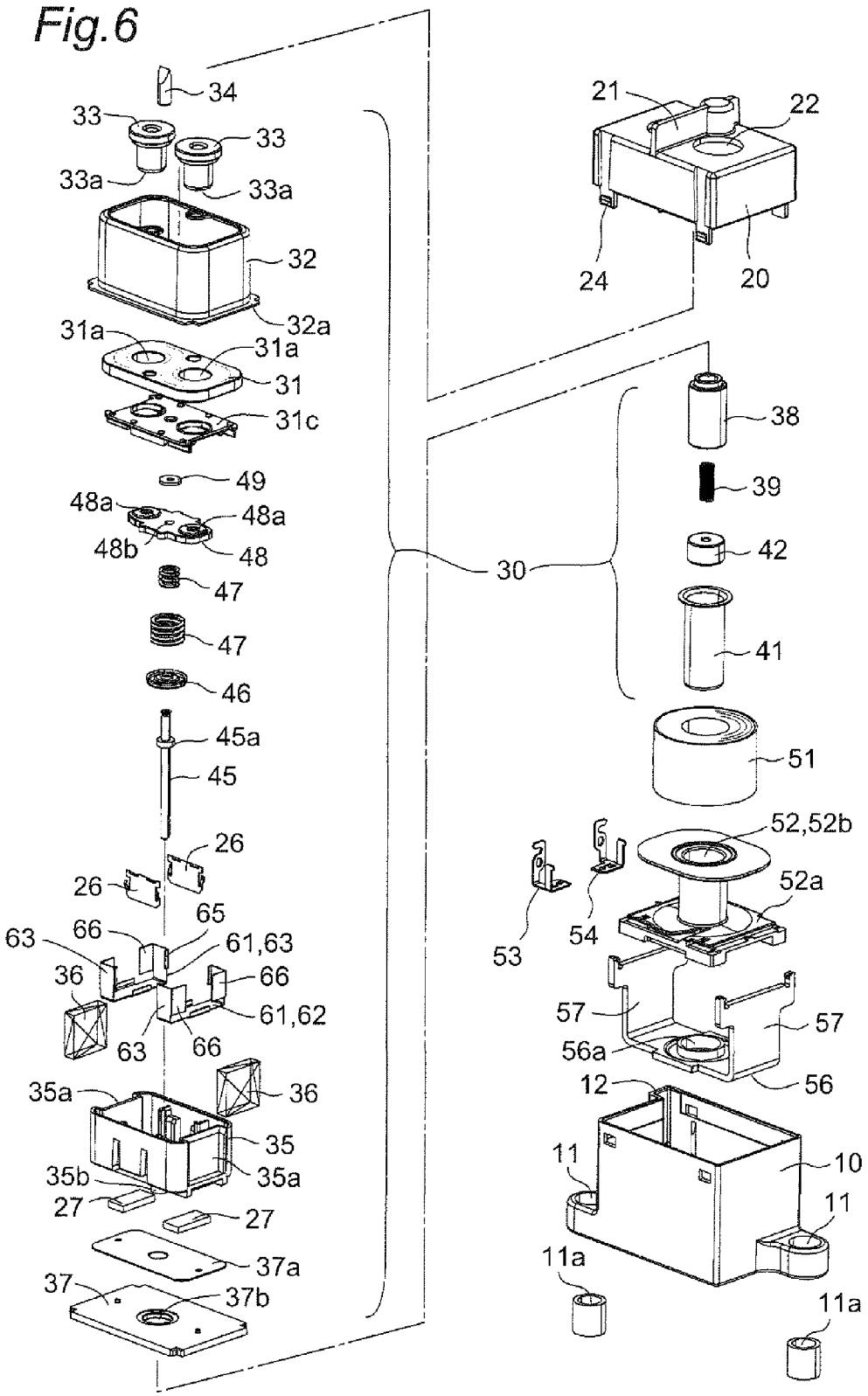
FIG. 6 is an exploded perspective view showing the sealed contact device illustrated in FIG. 1A according to one or more embodiments of the present invention.
Figure 7:
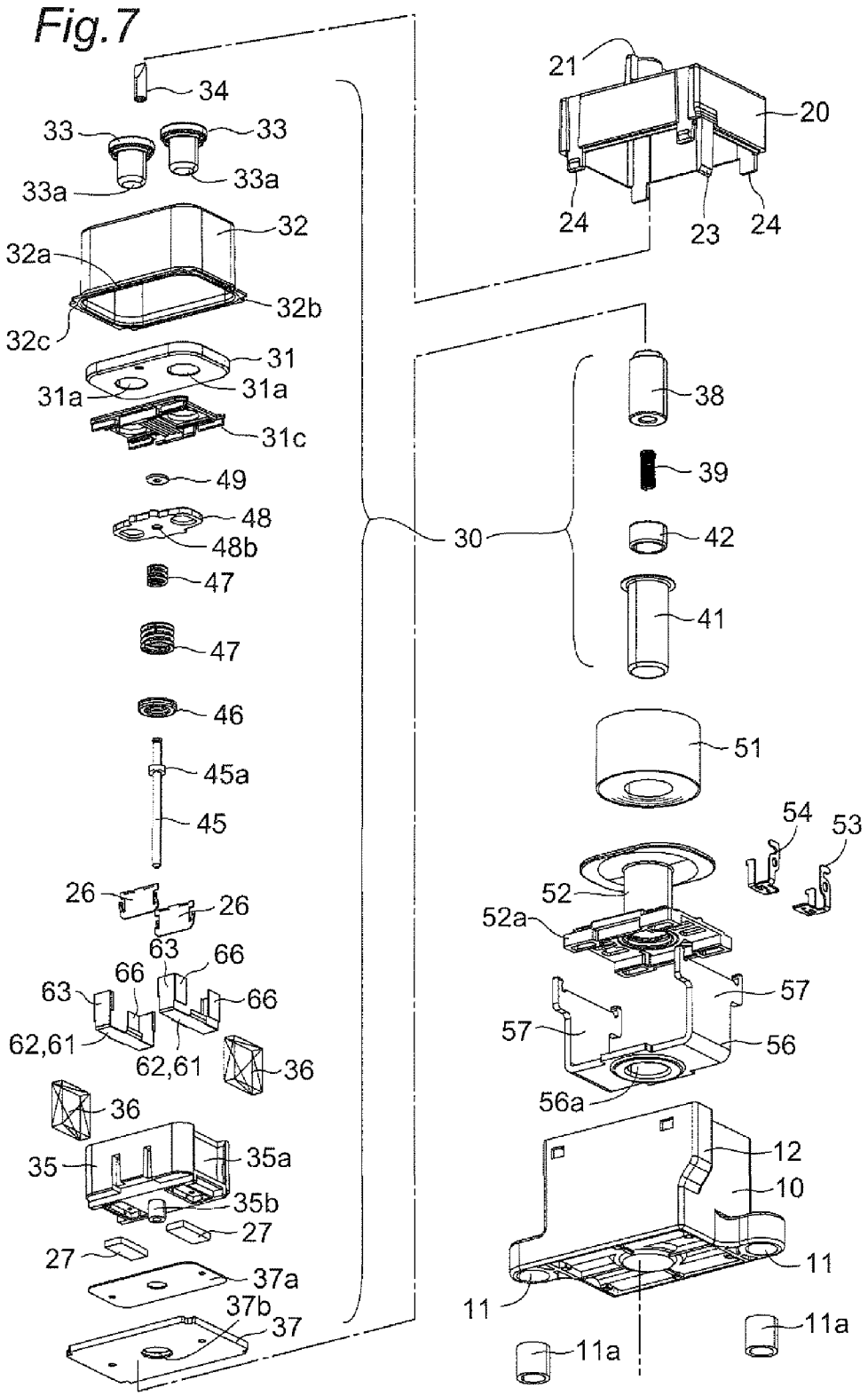
FIG. 7 is an exploded perspective view showing the sealed contact device illustrated in FIG. 1B according to one or more embodiments of the present invention.

Referring to a sealing type electromagnetic relay according to one or more embodiments, as shown in FIGS. 1 to 10, particularly, FIGS. 6 and 7, a contact mechanism portion 30 and an electromagnet portion 50 for driving the contact mechanism portion 30 from an outside of a sealed space 43 are accommodated in a housing formed by assembling a cover 20 into a case 10. The contact mechanism portion 30 is assembled into the sealed space 43 including a ceramic plate 31, a metallic cylindrical flange 32, a plate-shaped first yoke 37 and a bottom-closed cylindrical member 41.

The case 10 is a resin molded product which is almost box-shaped. Also the case is provided on an outside surface at lower corner parts with attaching holes 11 each having mounting fittings 11*a* press fitted therein, and also provided one side surface with a bulged portion 12 for pulling out a lead wire (not shown) and on the opposite side at an opening edge part with engaging holes 13.

The cover 20 takes a planar shape capable of covering an opening portion of the case 10, and furthermore, terminal holes 22 and 22 are provided on both sides of a partition wall 21 protruding from a center of an upper surface thereof. Moreover, the cover 20 has a protruding portion 23 provided on one side surface thereof. The protruding portion 23 can prevent so-called flapping of the lead wire (not shown) by insertion into the bulged portion 12 of the case 10. Furthermore, the cover 20 has an engaging click portion 24 provided on the opening edge part of the opposed side surface. The engaging click portion 24 can be engaged with the engaging hole 13 of the case 10.

The contact mechanism portion 30 is disposed in the sealed space 43 defined by the ceramic plate 31, the metallic cylindrical flange 32, the plate-shaped first yoke 37 and the bottomed cylindrical member 41 (see FIG. 2) as described above, and includes a magnet holder 35, a cylindrical stationary iron core 38, a moving iron core 42, a moving shaft 45 and a moving contact piece 48.

The ceramic plate 31 takes a planar shape which can be brazed to an upper opening edge part of the metallic cylindrical flange 32 as will be described below, which is provided with a pair of terminal holes 31*a* and 31*a*, and is used in combination with an auxiliary plate 31*c*. Moreover, the ceramic plate 31 has a metal layer (not shown) formed on an outer peripheral edge part of an upper surface thereof and an opening edge part of the terminal hole 31*a*. As shown in FIG. 6, a stationary contact terminal 33 is brazed to the terminal hole 31*a* of the ceramic plate 31. The stationary contact terminal 33 has a stationary contact 33*a* fixed to a lower end.

Figure 8A:
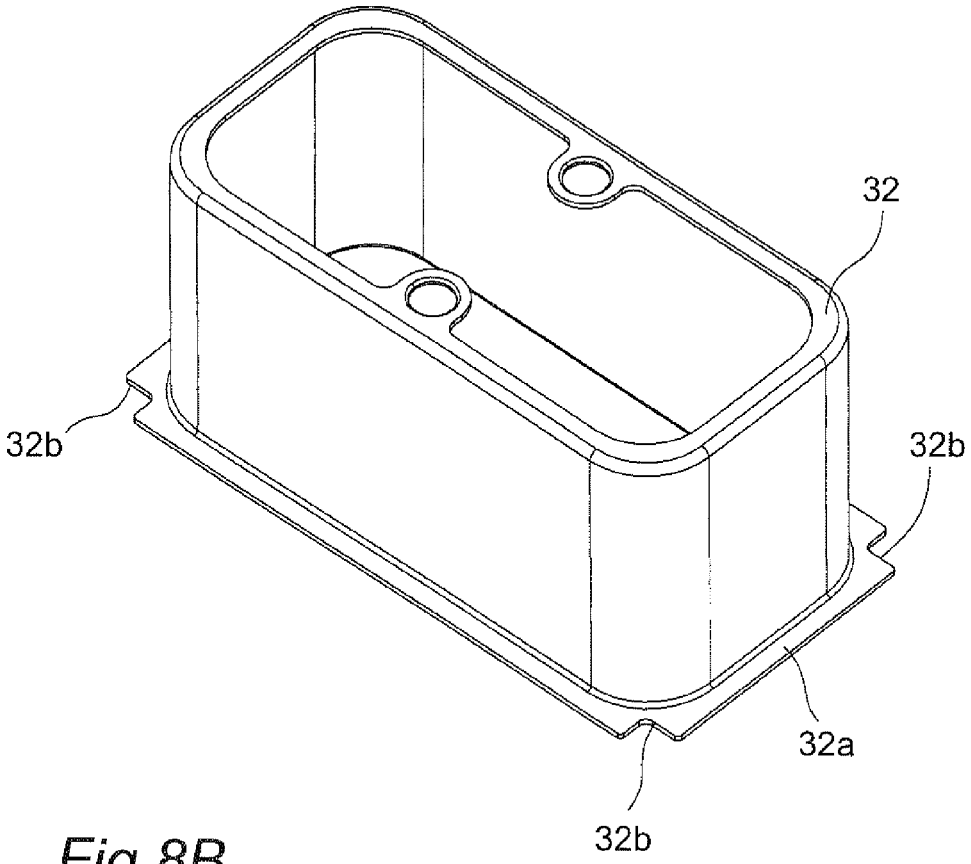
FIGS. 8A and 8B are perspective views showing a metallic cylindrical flange and a first yoke illustrated in FIG. 6, respectively, according to one or more embodiments of the present invention.
Figure 8B:
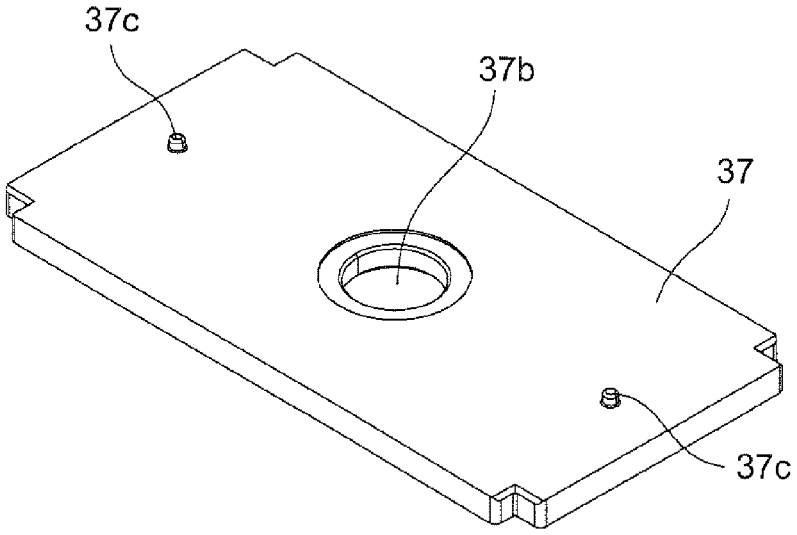
Figure 9A:
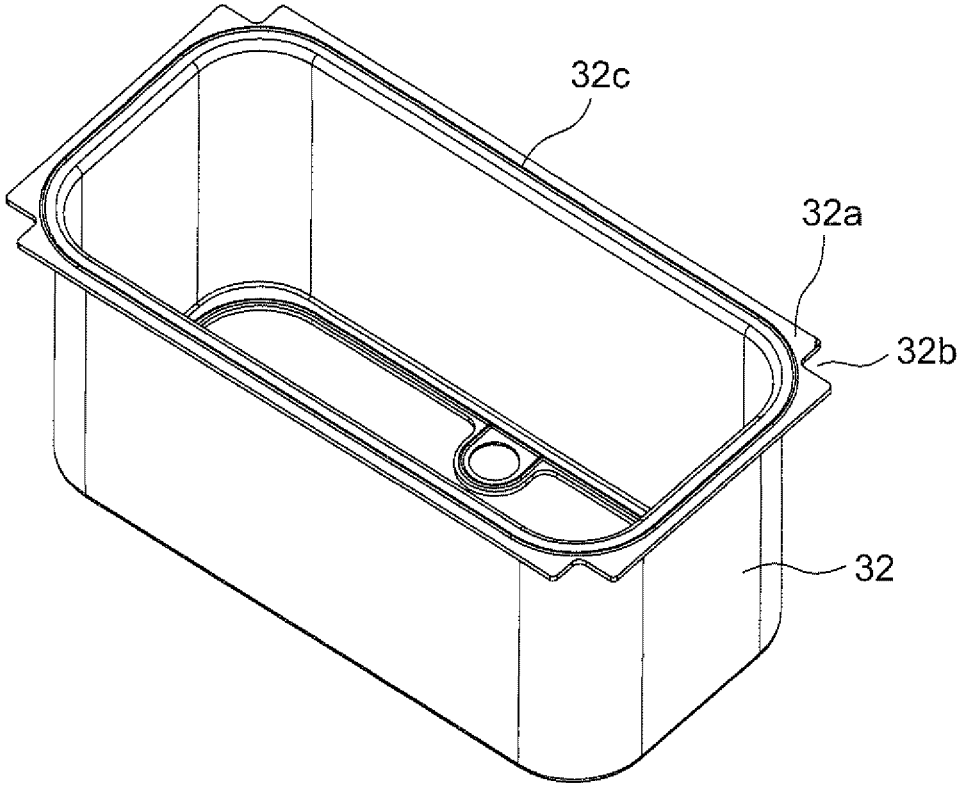
FIGS. 9A and 9B are a perspective view and a partial enlarged sectional view showing the metallic cylindrical flange illustrated in FIG. 6, respectively, as seen at a different angle according to one or more embodiments of the present invention.
Figure 9B:
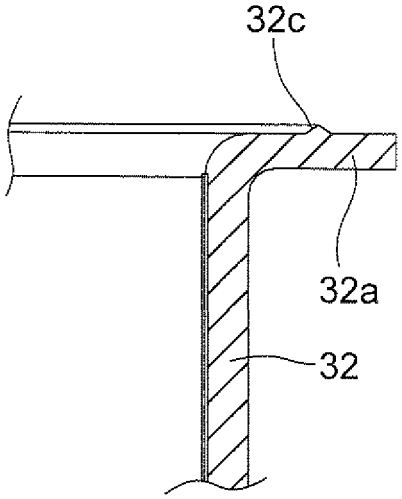

As shown in FIG. 8, the metallic cylindrical flange 32 to be welded and integrated with an outer peripheral edge part on an upper surface of the ceramic plate 31 takes an almost cylindrical shape obtained by forming a metal plate through a press process. In the metallic cylindrical flange 32, particularly, a ring-shaped flange portion 32*a* extends laterally from a lower opening edge part thereof and a cut-out portion 32*b* is formed at corner parts of the ring-shaped flange portion 32*a*. In the metallic cylindrical flange 32, a ring-shaped projection 32*c* is formed along a lower surface of the ring-shaped flange portion 32*a* by performing a panel beating process on the ring-shaped flange portion 32*a* twice from side to side as shown in FIG. 9. The ring-shaped projection 32*c* may be formed by a knocking process on the ring-shaped flange portion 32*a*.

The metallic cylindrical flange 32 is integrated with an upper surface of the plate-shaped first yoke 37 (which will be described below) by resistance welding through the ring-shaped projection 32*c* provided on the ring-shaped flange portion 32*a*. However, the ring-shaped projection 32*c* is formed in a remote position spaced away from the cut-out portion so that poor or improper welding can be avoided in the resistance welding process.

The magnet holder 35 to be accommodated in the metallic cylindrical flange 32 is formed by a heat-resistant insulating material taking a shape of a box, and has a pocket groove 35*a* formed on outside surfaces at both opposed ends. The pocket groove 35*a* can hold a permanent magnet 36. Moreover, the magnet holder 35 has a ring-shaped receiving table 35*c* provided on a center of a bottom surface so as to be lower by one step (see FIG. 2), and furthermore, has a cylindrical insulating portion 35*b* protruding toward a lower side from a center of the ring-shaped receiving table 35*c*. Even if an arc is generated when a voltage is raised along a path through the metallic cylindrical flange 32, the plate-shaped first yoke 37 and the cylindrical stationary iron core 38, the cylindrical insulating portion 35*b* insulates the cylindrical stationary iron core 38 and the moving shaft 45 from each other, thereby preventing their welding integration. Furthermore, the positioning plate 26 is disposed to abut on the moving contact piece 48 opposite to an inner part of the magnet holder 35 and rotation of the moving contact piece 48 is prevented so as to position the moving contact piece 48. A pair of rubber plates 27 is disposed between the magnet holder 35 and the first yoke 37 to absorb a shock generated between the magnet holder 35 and the ring-shaped flange portion 45*a* when the stationary contact 33*a* is spaced away from the moving contact 48*a*.

Moreover, an arc shield member 61 according to one or more embodiments of the present invention is provided in the magnet holder 35. The arc shield member 61 is formed of a metal such as stainless, for example, and is formed to have a substantially U-shaped section as shown in FIG. 10A.

Figure 4A:
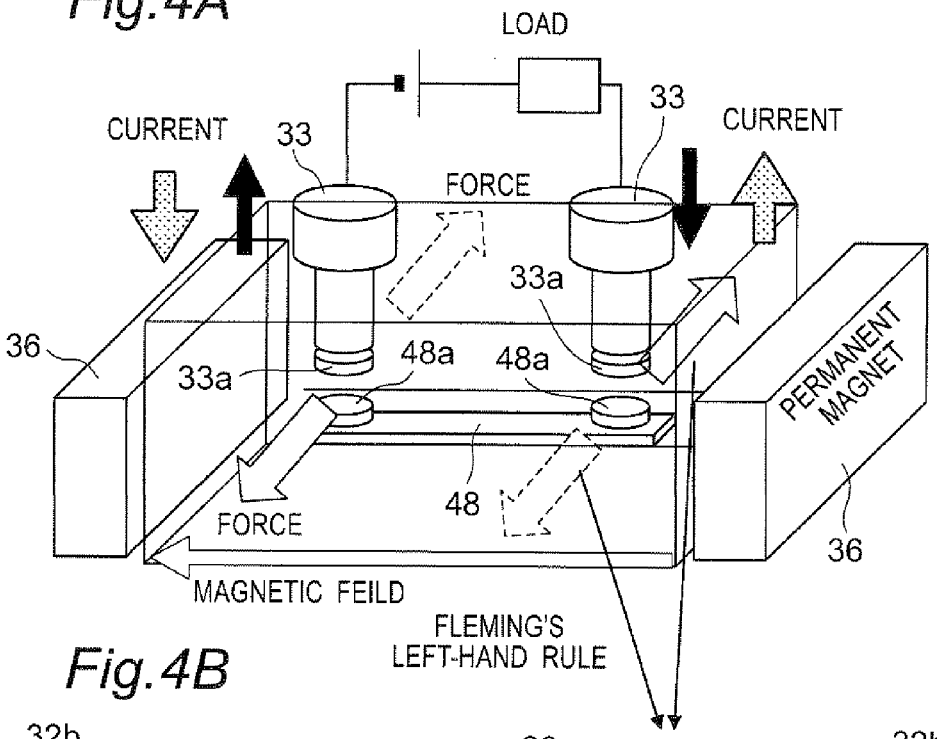
FIG. 4A is a schematic perspective view for illustrating a method for dissipating an arc and FIG. 4B is a partial plan sectional view showing the sealed contact device according to one or more embodiments of the present invention.
Figure 4B:
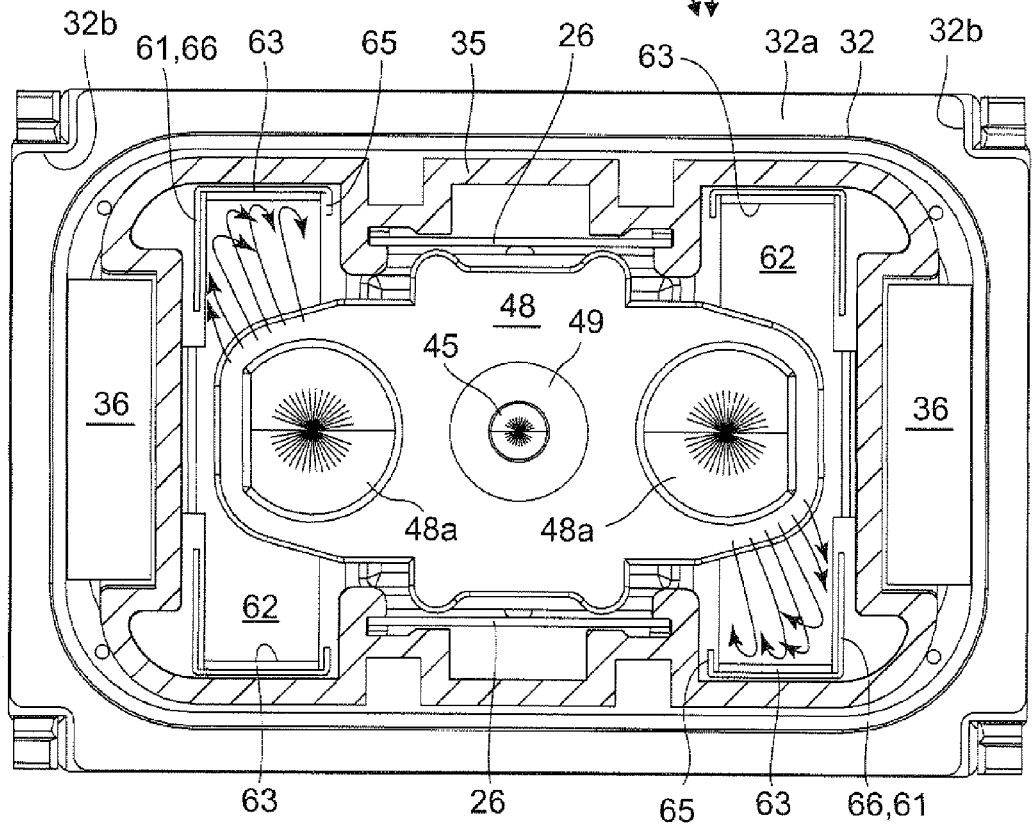
Figure 5B:
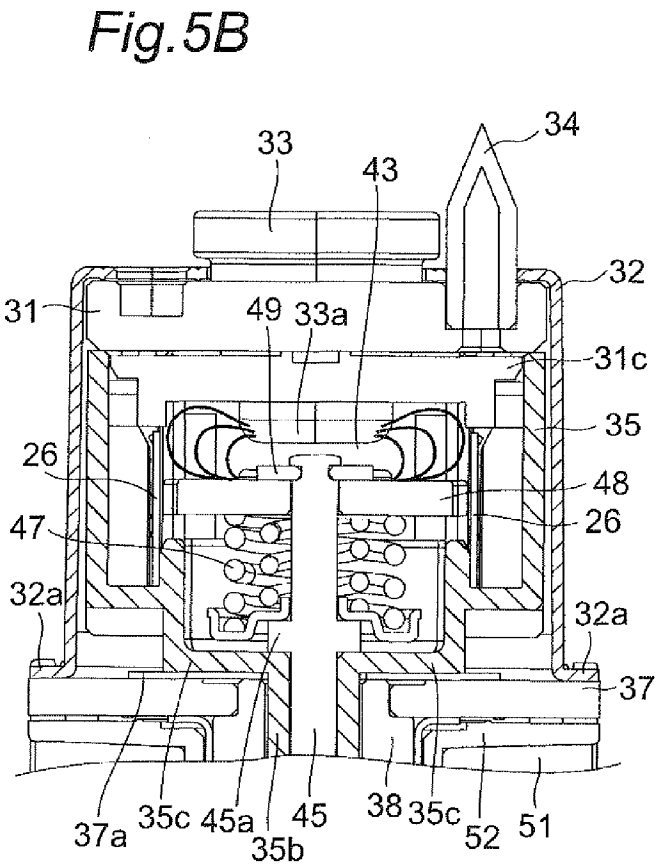
FIGS. 5A and 5B are a partial front sectional view and a partial side sectional view showing the sealed contact device, respectively, for illustrating the method for dissipating an arc according to one or more embodiments of the present invention.
Figure 5A:
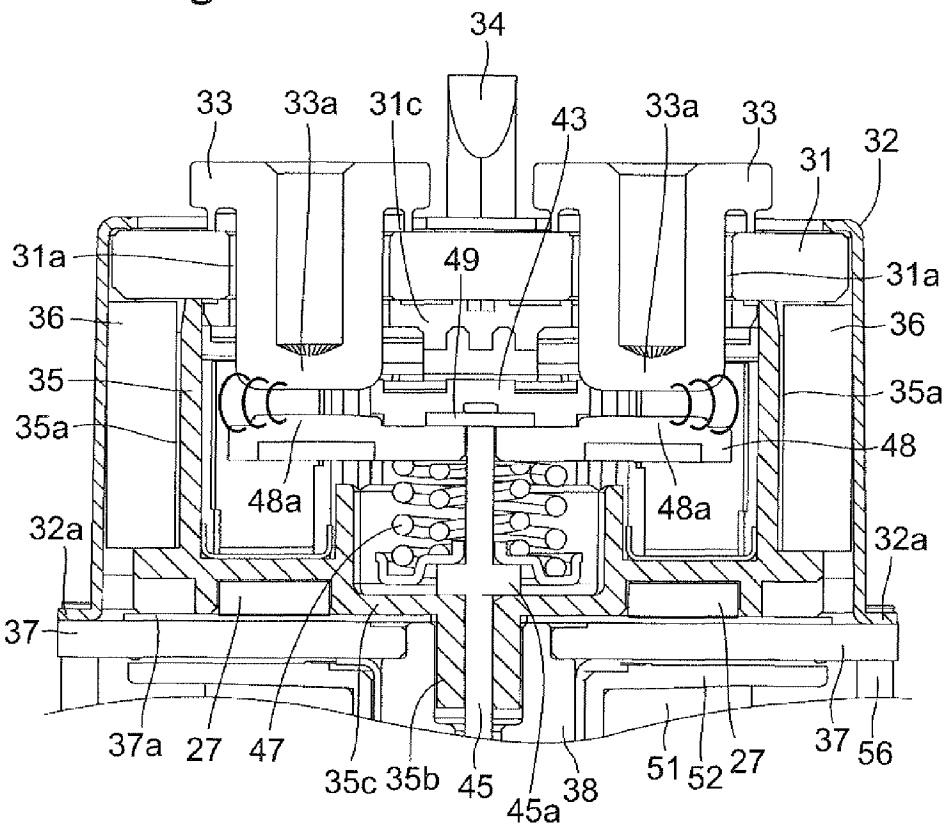
Figure 10A:
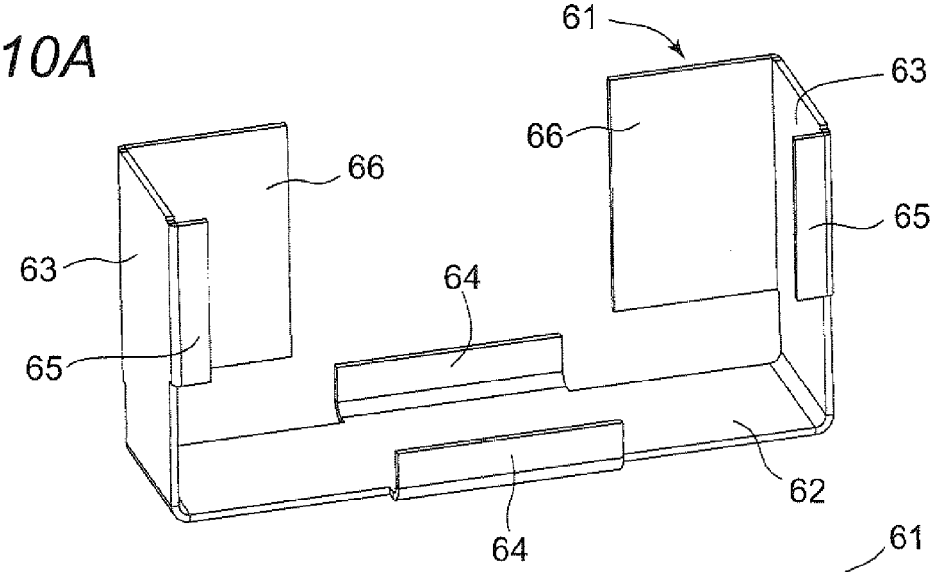
FIG. 10A is a perspective view showing an arc shield member illustrated in FIG. 1, and FIGS. 10B and 10C are perspective views showing shield members for an arc according to one or more embodiments of the present invention.

In other words, the arc shield member 61 includes a plate-shaped coupling member 62 and a pair of arm portions 63 formed by upwardly bending both ends of the coupling member 62 as shown in FIG. 10A. Positioning tongue pieces (arc receiving pieces) 64 cut and raised upward are formed on opposed edge parts of the coupling member 62. Each of the arm portions 63 has an inward rib (an arc receiving piece) 65 formed by bending both side edge parts toward the coupling member 62 side and an outward rib (an arc receiving piece) 66. A space is defined between a pair of the outward ribs 66 and 66 for allowing a magnetic flux of the permanent magnet 36 to pass therethrough. The arc shield member 61 has the coupling member 62 mounted on a bottom wall of the magnet holder 35 as shown in FIG. 2 and has the arm portion 63 fixed to opposed side walls of the magnet holder 35 as shown in FIG. 4B.

The plate-shaped first yoke 37 takes a planar shape which can be fitted in the opening edge part of the case 10, and has an elastic plate 37*a* fixed to an upper surface thereof and has a caulking hole 37*b* provided on a center thereof as shown in FIG. 6. As shown in FIG. 8B, moreover, a positioning projection 37*c* is provided on both sides of the caulking hole 37*b*. The plate-shaped first yoke 37 has an upper end of the cylindrical stationary iron core 38 caulked and fixed to the caulking hole 37*b*, while the ring-shaped projection 32*c* provided on the ring-shaped flange portion 32*a* of the metallic cylindrical flange 32 is integrated by resistance welding.

Figure 1A:
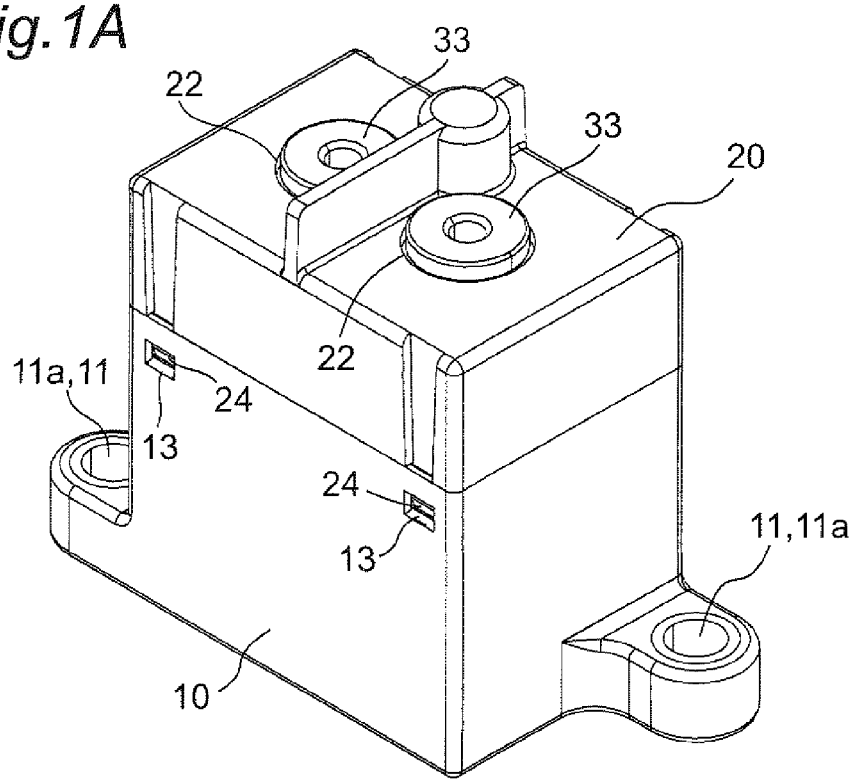
FIGS. 1A and 1B are general perspective views showing a sealed contact device according to one or more embodiments of the present invention as seen at a different angle.
Figure 1B:
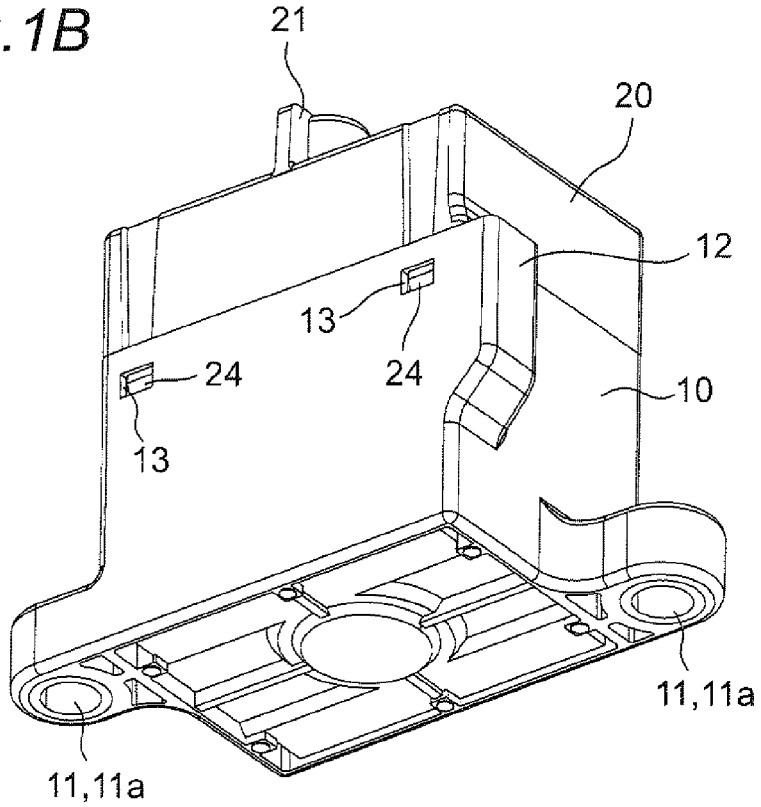
Figure 2:
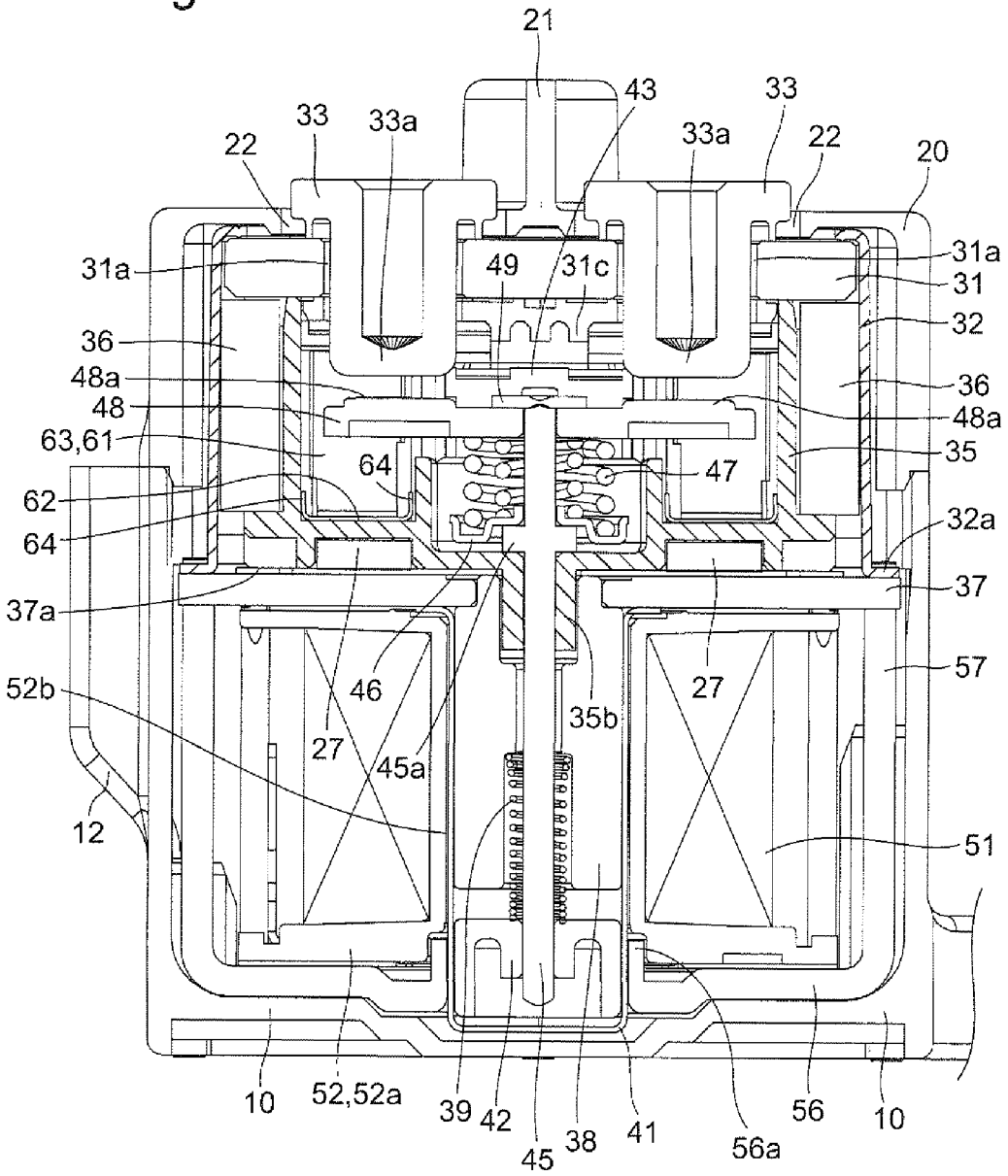
FIG. 2 is a front sectional view showing a state before an operation of the sealed contact device illustrated in FIG. 1 according to one or more embodiments of the present invention.
Figure 3:
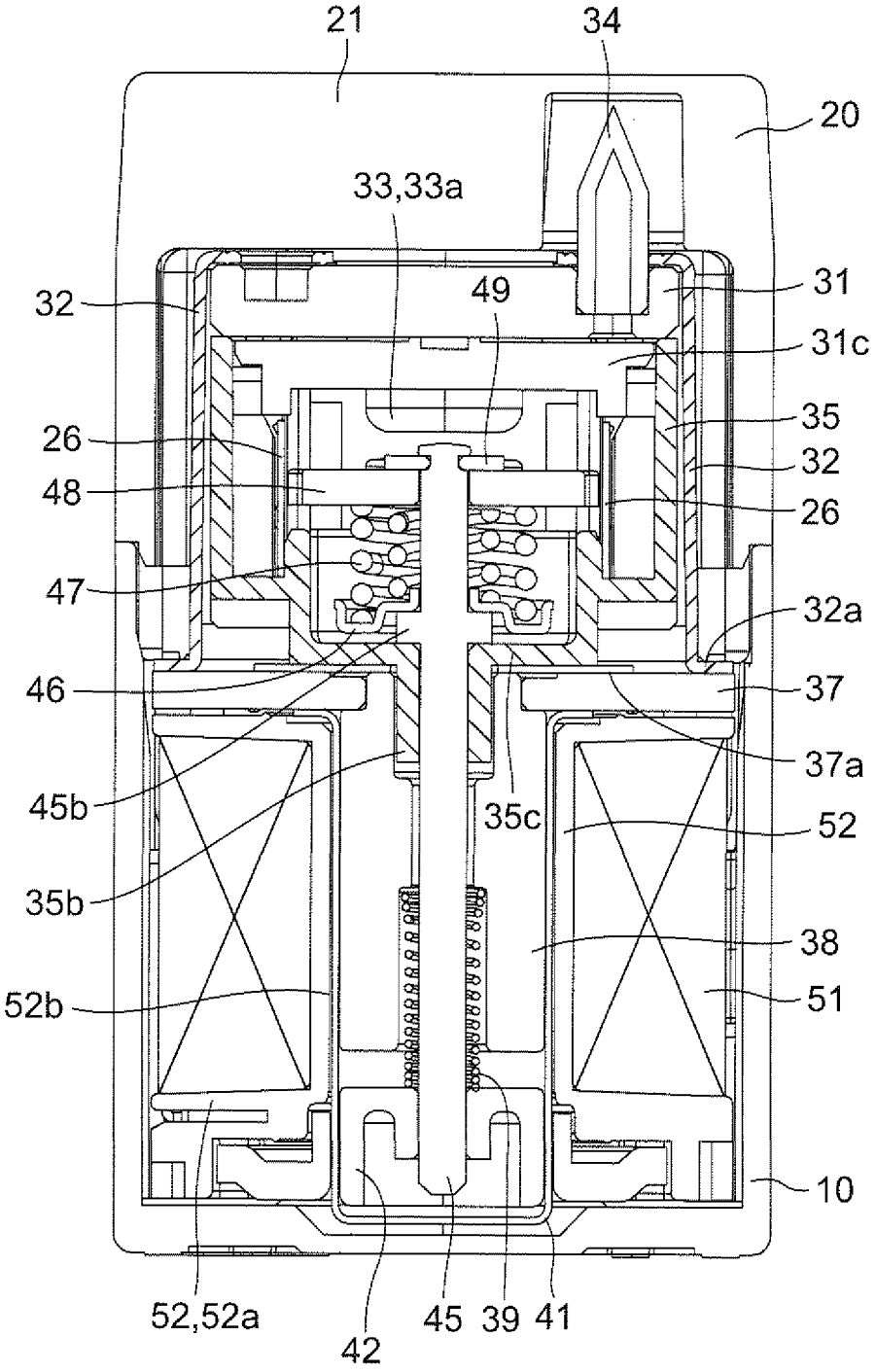
FIG. 3 is a side sectional view showing a state before the operation of the sealed contact device illustrated in FIG. 1 according to one or more embodiments of the present invention.

The cylindrical stationary iron core 38 has a through-hole in which the moving shaft 45 including the ring-shaped flange portion 45*a* is slidably inserted through the cylindrical insulating portion 35*b* of the magnet holder 35 as shown in FIG. 2. The moving shaft 45 has a return spring 39 inserted therein and has the moving iron core 42 fixed to a lower end thereof by welding.

The bottom-closed cylindrical member 41 for accommodating the moving iron core 42 has an opening edge part bonded hermetically with a lower surface edge part of the caulking hole 37*b* provided on the plate-shaped first yoke 37. Internal air is sucked from an evacuating pipe 34 to form the sealed space 43.

As shown in FIG. 2, the moving shaft 45 engages a plate-shaped receiving tool 46 with the ring-shaped or annular flange portion 45*a* provided in an intermediate part thereof and thus prevents drop out of the inserted contact spring 47 and moving contact piece 48, and fixes a locking ring 49 to an upper end thereof. The moving contacts 48*a* provided on both ends of the upper surface of the moving contact piece 48 are opposed to the stationary contacts 33*a* of the stationary contact terminal 33 disposed in the metallic cylindrical flange 32 so as to enable connection/disconnection.

As shown in FIG. 2, the electromagnet portion 50 press fits and fixes coil terminals 53 and 54 to a flange portion 52*a* of a spool 52 around which a coil 51 is wound, and connects the coil 51 to a lead wire which is not shown through the coil terminals 53 and 54. The bottom-closed cylindrical member 41 is inserted into a through hole 52*b* of the spool 52 and is fitted in a fitting hole 56*a* of a second yoke 56. Subsequently, upper ends of both side portions 57 and 57 of the second yoke 56 are engaged with both ends of the plate-shaped first yoke 37 and are thus fixed by means such as caulking, press fitting, welding or the like. Consequently, the electromagnet portion 50 and the contact mechanism portion 30 are integrated with each other.

Next, an operation of the hermetically sealed electromagnetic relay so structured will be described herein.

First of all, in the case in which a voltage is not applied to the coil 51 as shown in FIG. 2, the moving iron core 42 is biased downward by a spring force of the return spring 39, the moving shaft 45 is pushed downward and the moving contact piece 48 is pulled downward. At this time, the ring-shaped flange portion 45*a* of the moving shaft 45 is engaged with the ring-shaped receiving table 35*c* of the magnet holder 35, and the moving contact 48*a* is spaced away from the stationary contact 33*a*. However, the moving iron core 42 is not in abutment onto the bottom surface of the bottom-closed cylindrical member 41.

Once the coil 51 is applied with a voltage for magnetization, the moving iron core 42 is sucked into the cylindrical stationary iron core 38 so that the moving shaft 45 is slid upward against the spring force of the return spring 39. Also after the moving contacts 48*a* come in contact with the stationary contacts 33*a*, the moving shaft 45 is pushed up against the spring forces of the return spring 39 and the contact spring 47, and the upper end of the moving shaft 45 comes up from the shaft hole 48*b* of the moving contact piece 48 so that the moving iron core 42 contacts with the cylindrical stationary iron core 38.

When the application of the voltage to the coil 51 is cut off for demagnetization, the moving iron core 42 is biased away from the cylindrical stationary iron core 38 based on the spring forces of the contact spring 47 and the return spring 39. For this reason, the moving shaft 45 is slid downward and the moving contacts 48*a* are disconnected from the stationary contacts 33*a*. Then, the ring-shaped flange portion 45*a* of the moving shaft 45 is engaged with the ring-shaped receiving table 35*c* of the magnet holder 35 and is returned into an original state.

In some cases, an arc may be generated between the stationary contacts 33*a* having a high voltage and the moving contacts 48*a*. The arc is induced according to the Fleming's left-hand rule by a current conducting between the stationary contacts 33*a* and the moving contacts 48*a* and a magnetic force generated in a horizontal direction between the opposed permanent magnets 36 in FIG. 4A.

For example, in the case in which a current (a black arrow) flows from the moving contact 48*a* toward the stationary contact 33*a* (from a lower side toward an upper side in the paper) and a magnetic force (a long and thin white arrow) of the permanent magnet 36 is applied in a perpendicular direction to the current (from a right side to a left side in the paper), an arc is induced/drawn in a direction perpendicular to those of the current and the magnetic force (from an inner side to this side in the paper).

In general, a direction of the magnetic force is gradually more curved like a circular arc as being apart from a central axis of the opposed permanent magnets 36. Moreover, the current also flows to the induced arc by the current and the magnetic force and a direction of flow of the arc current is also curved, and at the same time, is curved from the moving contact 48*a* to the stationary contact 33*a*. These factors are added so that the arc generated between the stationary contact 33*a* and the moving contact 48*a* is induced/drawn more closely to the permanent magnet 36 apart from the contact.

Accordingly, the arm portion 63 of the arc shield member 61 is disposed in such a direction that the arc is first induced (i.e., a direction perpendicular to the current and the magnetic force), and outward ribs 66 are disposed to cover a part of the permanent magnet 36 in a direction in which the generated arc is further induced in a direction being closer to the permanent magnet 36. Yet, between the outward ribs 66 is provided a gap so as not to cover the central axis of the permanent magnet 36. For this reason, also in the case in which the direction of the current conducting between the stationary contact 33*a* and the moving contact 48*a* is switched, the arc induced by the magnetic force generated in a horizontal direction between the opposed permanent magnets 36 can be dissipated through impingement of the arc onto the arc shield member 61.

Moreover, the arc shield member 61 prevents the arc from directly impinging onto the magnet holder 35. Therefore, it is also possible to prevent deterioration in the permanent magnet 36 which is caused by the damage of the magnet holder 35.

In particular, the arc shield member 61 has the inward rib 65 and the outward rib 66 with the both side edge parts of the arm portion 63 so as to enclose the generated arc in an efficient manner, thereby dissipating the arc before reaching the magnet holder 35.

Moreover, each of the arc shield members 61 has a cross section in a gate type configuration or a twin-L-shaped configuration (in which a pair of the arc shield members 61 of each having complementary L-shaped sections are arranged so that the outward ribs 66 thereof oppose to each other), and the coupling member (base portion) 62 is mounted on a bottom surface of the magnet holder 35 within the sealed space 43 (the magnet holder 35). This facilitates the arc shield member 61 to be held and access for assembly within the sealed space 43 (the magnet holder 35) when compared with configuration of a simple plate shape thereof. Moreover, this ensures the arc shield member 61 to be seated in the sealed space 43 of the arc shield member 61 without disturbing switching operations of the stationary contacts 33*a* and the moving contacts 48*a*.

Furthermore, the arm portions 63 of the arc shield members 61 are disposed to oppose the permanent magnets 36 at both sides of the stationary contacts 33*a* and the moving contacts 48*a*. For this reason, even if a direction of the current or the magnetic flux is changed so that a direction of the generation of the arc is varied, the arc can be caused to dissipate by impingement with one of the arm portions 63.

Since the arc shield member 61 is made of a metal, it has a high capability of efficiently cooling the arc impinging onto the arc shield member 61 and thus dissipating the arc.

Figure 10B:
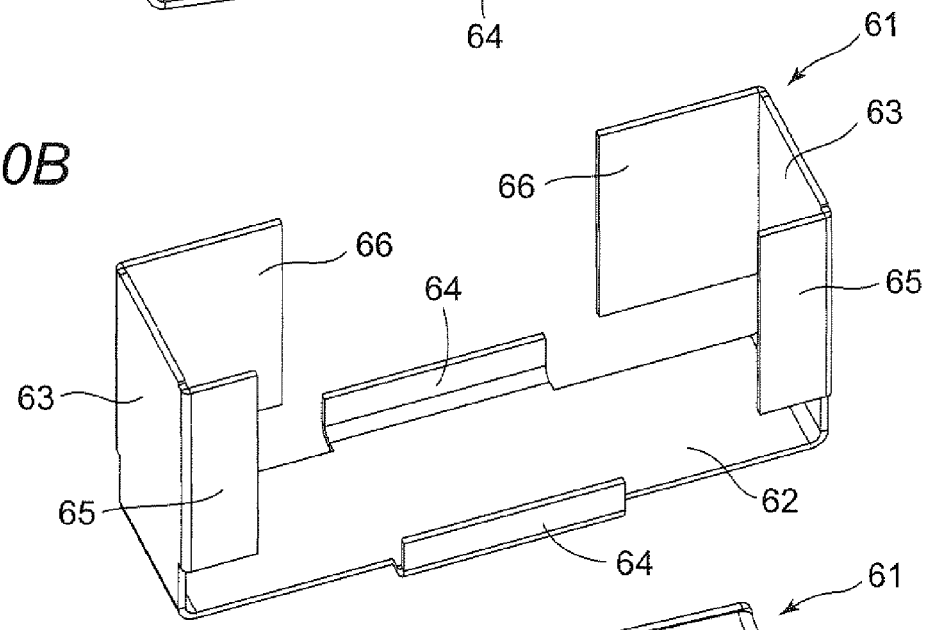

FIG. 10B shows an arc shield member 61 according to one or more embodiments of the present invention.

The arc shield member 61 according to one or more embodiments has the arm portion 63 provided with the inward rib 65 larger than that of one or more other embodiments. In the case in which the generated arc enters the arm portion 63, the arc can be enclosed and thus dissipated in a more reliable and efficient manner.

Figure 10C:
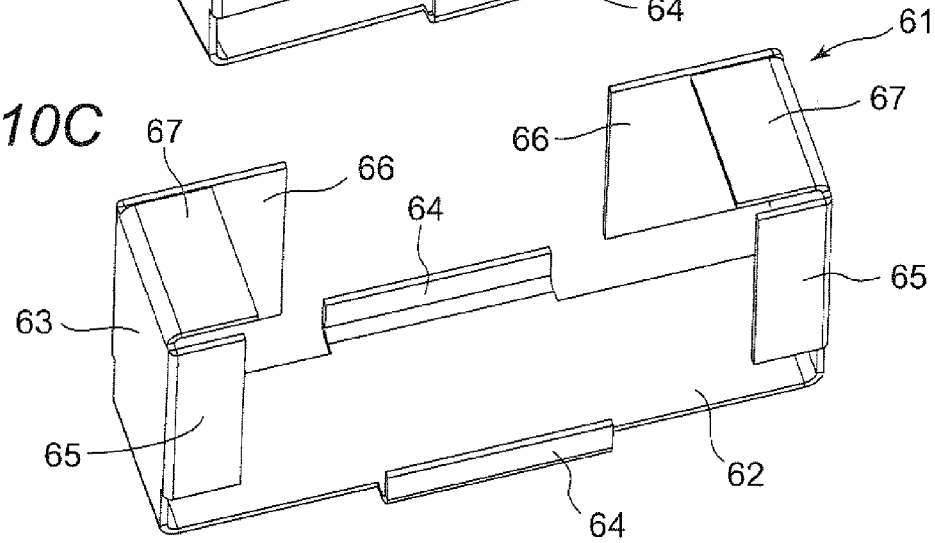

FIG. 10C shows an arc shield member 61 according to one or more embodiments of the present invention.

One or more embodiments are different from one or more other embodiments in view of that each of the arm portions 63 is bent toward the coupling member 62 to form an upper ribs 67 extending therefrom.

According to one or more embodiments, in the case in which a generated arc enters the arm portion 63, the arc can be enclosed and thus dissipated in a more reliable and efficient manner.

Figure 11A:
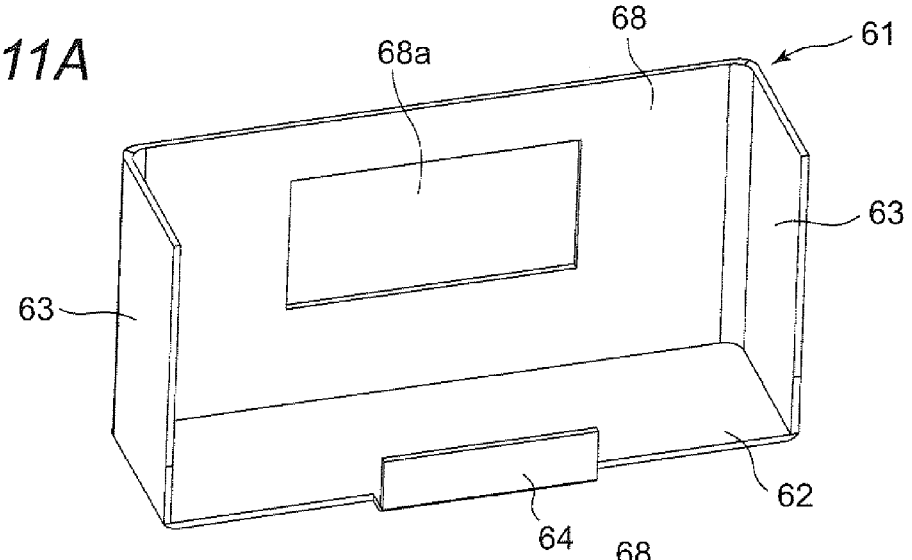
FIGS. 11A, 11B and 11C are perspective views showing shield members for an arc according to one or more embodiments of the present invention.

FIG. 11A shows an arc shield member 61 according to one or more embodiments of the present invention.

One or more embodiments are different from one or more other embodiments in view of that a partition wall 68 is formed to bridge a pair of the arm portions 63 and 63 so that a magnetic flux hole 68*a* is defined in the partition wall 68, thereby allowing the magnetic flux passing therethrough.

According to one or more embodiments, there is an advantage that it is possible to obtain an arc shield member 61 which has an enhanced mechanical strength and reliably prevents the arc from impinging onto the permanent magnet.

Figure 11B:
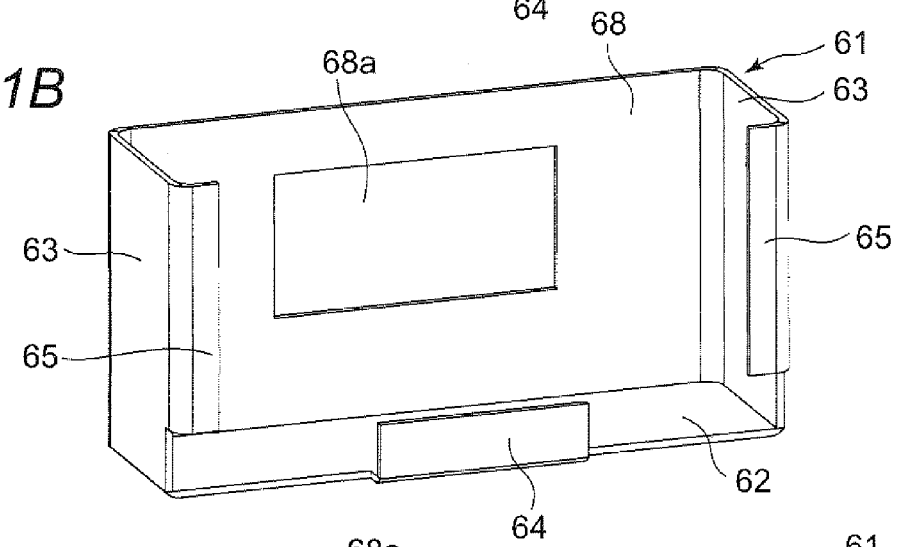
Figure 11C:
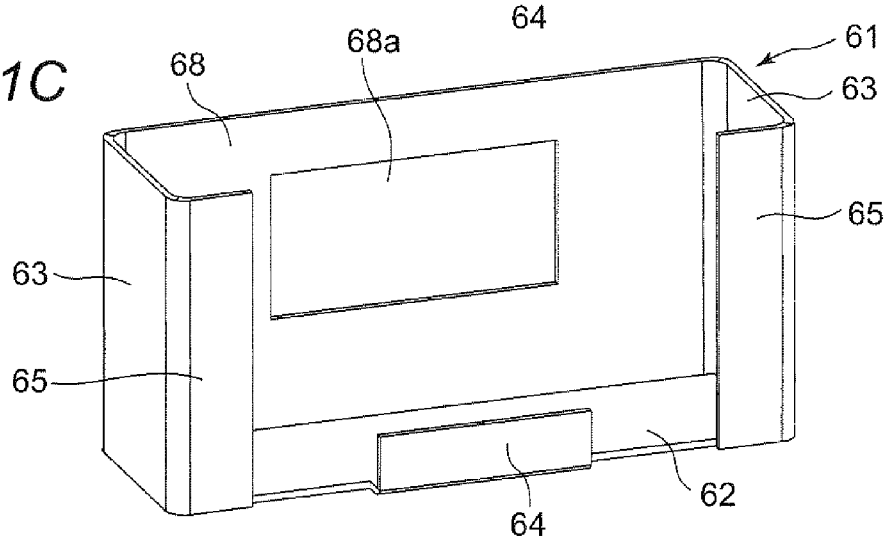

FIGS. 11B and 11C show an arc shield member 61 according to one or more embodiments of the present invention.

The arc shield member 61 according to one or more embodiments includes inward ribs 65 provided on the inward edge parts of the arm portions 63, and the partition wall 68 having the magnetic flux hole 68*a* at a peripheral end thereof. Also, the arc shield member 61 according to one or more embodiments includes inward ribs 65 provided on the inward edge parts of the arm portions 63, and a partition wall 68 having a magnetic flux hole 68*a* at a peripheral end thereof. The inward rib 65 reaches the coupling member 62. One or more embodiments have advantages that a mechanical strength is enhanced and an arc is reliably prevented from impinging onto the permanent magnet.

Figure 12A:
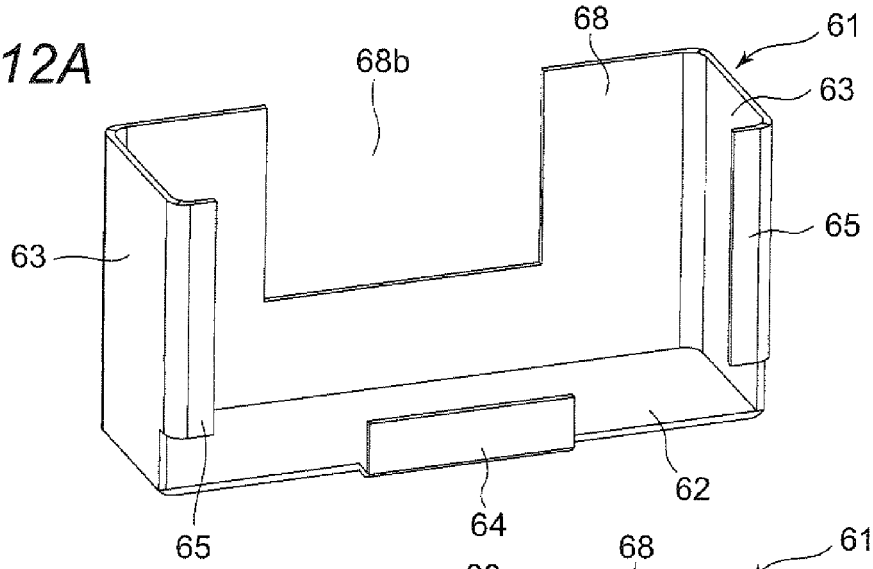
FIGS. 12A, 12B and 12C are perspective views showing shield members for an arc according to one or more embodiments of the present invention.

FIG. 12A shows an arc shield member 61 according to one or more embodiments of the present invention.

The arc shield member 61 according to one or more embodiments includes inward ribs 65 and 65 formed on the inward edge parts of the arm portions 63 and 63, and also the partition wall 68 bridging a pair of the arm portions 63 and 63, which has a cut-out portion 68*b* over peripheral end thereof.

According to one or more embodiments, the arc shield member 61 can be achieved at high production yield, which enhances mechanical strength and efficiently dissipates an arc.

Figure 12B:
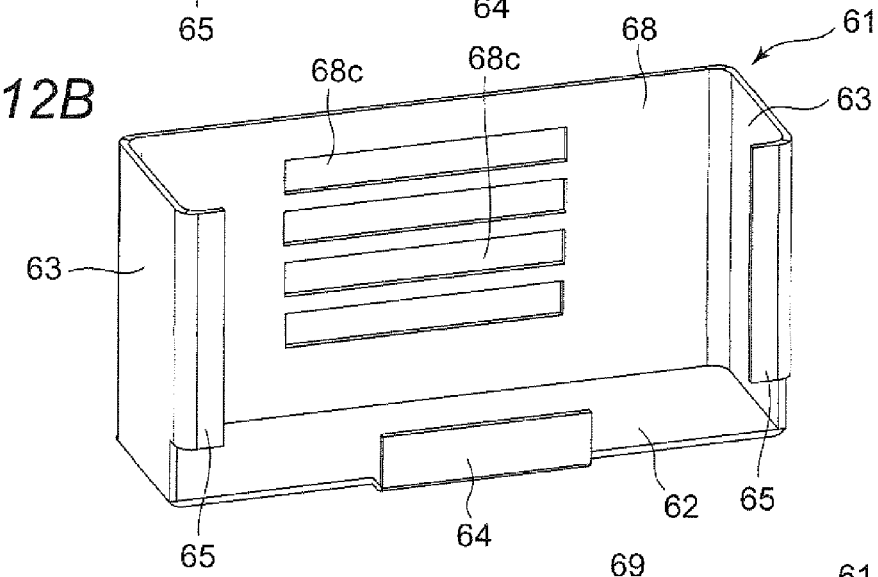

FIG. 12B shows an arc shield member 61 according to one or more embodiments of the present invention.

The arc shield member 61 according to one or more embodiments has inward ribs 65 and 65 formed on inward edge parts of the arm portions 63 and 63, and a partition wall 68 bridging a pair of the arm portions 63 and 63 over the peripheral end thereof, which has a plurality of slits 68*c* extending in parallel therebetween.

According to one or more embodiments, a magnetic flux of a permanent magnet can pass through the slits 68*c* provided on the partition wall 68, and furthermore, an arc can be prevented from impinging and dissipated in a reliable manner.

Figure 12C:
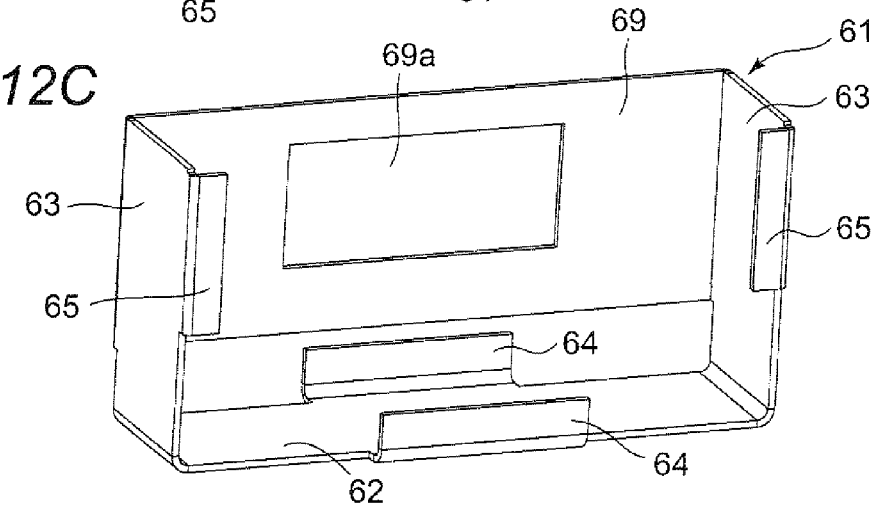

FIG. 12C shows an arc shield member 61 according to one or more embodiments of the present invention.

The arc shield member 61 according to one or more embodiments has inward ribs 65 and 65 formed on inward edge parts of arm portions 63 and 63, and a partition wall 69 bridging a pair of the arm portions 63 and 63 over the peripheral end thereof. The partition wall 69 has a lower end edge part spaced away from the coupling member 62 in such a manner that positioning tongue pieces 64 and 64 can be formed on both peripheral edges of the coupling member 62. The partition wall 69 has a magnetic flux hole 69*a* formed thereon.

According to one or more embodiments, the arc shield member 61 can be achieved at high production yield, which enhances mechanical strength and facilitates alignment or positioning thereof. Other structures of the eighth embodiment are similar and applicable to ones of the first embodiment, and thus the same portions have the same reference numerals and duplicated explanation will be eliminated.

A distance between the outward ribs 66 and 66, a width of the magnetic flux holes 68*a* and 69*a*, a width of the cut-out portion 68*b* and a width of the slit 68*c* should be equivalent to or more than at least a diameter of a contact. This facilitates the magnetic flux for drawing an arc to be guided and ensures an attraction force to an arc.

Moreover, height of the magnetic flux holes 68*a* and 69*a* and height of the slit 68*c* should be equivalent to or more than at least a distance between the contacts. Also in the case in which the height of one of the slits 68*c* is smaller than the distance between the contacts, it is sufficient that a sum of the height dimensions of the slits 68*c* is equivalent to or more than the distance between the contacts. The reason is that the passage of a magnetic flux for drawing an arc is to be eased and a drawing force is to be ensured.

Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

INDUSTRIAL APPLICABILITY

It is a matter of course that the sealed contact device according to the present invention is not limited to the hermetically sealed electromagnetic relay but may also be applied to other electromagnetic switches.

DESCRIPTION OF REFERENCE SYMBOLS

10 CASE (HOUSING)
20 COVER (HOUSING)
32 METALLIC CYLINDRICAL FLANGE
32*a* RING-SHAPED FLANGE PORTION
32*b* CUT-OUT PORTION
32*c* RING-SHAPED PROJECTION
33*a* STATIONARY CONTACT
36 PERMANENT MAGNET
37 PLATE-SHAPED FIRST YOKE
37*a* ELASTIC PLATE
37*b* CAULKING HOLE
37*c* POSITIONING PROJECTION
43 SEALED SPACE
48*a* MOVING CONTACT
61 SHIELD MEMBER FOR ARC
62 COUPLING MEMBER (BASE PORTION)
63 ARM PORTION
64 TONGUE PIECE (ARC RECEIVING PIECE)
65 INWARD RIB (ARC RECEIVING PIECE)
66 OUTWARD RIB (ARC RECEIVING PIECE)
67 UPWARD RIB (ARC RECEIVING PIECE)
68 PARTITION WALL (ARC RECEIVING PIECE)
68*a* MAGNETIC FLUX HOLE
68*b* CUT-OUT PORTION
68*c* SLIT
69 PARTITION WALL (ARC RECEIVING PIECE)
69*a* MAGNETIC FLUX HOLE

The invention claimed is:

1. A sealed contact device comprising:
a housing;
a stationary contact and a moving contact which are disposed opposite to each other in the housing; and
a pair of permanent magnets disposed each opposite to the stationary contact and the moving contact;
an arc generated between the stationary contact and the moving contact being drawn due to a current conducting between the stationary contact and the moving contact and a magnetic force of the permanent magnet,
wherein an arc shield member is disposed in a position in which an arc in the housing is drawn,
wherein the arc shield member has a gate type section including a plate-shaped coupling member and arm portions formed by substantially perpendicularly bending both ends of the coupling member, and
wherein a partition wall including a magnetic flux hole is bridged between outer edge parts of the pair of arm portions.

2. The sealed contact device according to claim 1, wherein at least one arc receiving piece is provided on at least one of edge parts of the coupling member and the arm portion in the arc shield member.

3. The sealed contact device according to claim 1, wherein an upper rib is extended laterally from at least one of upper edge parts of the pair of arm portions.

4. The sealed contact device according to claim 2, wherein an upper rib is extended laterally from at least one of upper edge parts of the pair of arm portions.

5. A sealed contact device comprising:
a housing;
a stationary contact and a moving contact which are disposed opposite to each other in the housing; and
a pair of permanent magnets disposed each opposite to the stationary contact and the moving contact;
an arc generated between the stationary contact and the moving contact being drawn due to a current conducting between the stationary contact and the moving contact and a magnetic force of the permanent magnet,
wherein an arc shield member is disposed in a position in which an arc in the housing is drawn,
wherein the arc shield member has a gate type section including a plate-shaped coupling member and arm portions formed by substantially perpendicularly bending both ends of the coupling member,
wherein a partition wall including a cut-out portion is bridged between outer edge parts of the pair of arm portions.

6. The sealed contact device according to claim 5, wherein at least one arc receiving piece is provided on at least one of edge parts of the coupling member and the arm portion in the arc shield member.

7. The sealed contact device according to claim 5, wherein an upper rib is extended laterally from at least one of upper edge parts of the pair of arm portions.

8. The sealed contact device according to claim 6, wherein an upper rib is extended laterally from at least one of upper edge parts of the pair of arm portions.

9. A sealed contact device comprising:

a housing;

a stationary contact and a moving contact which are disposed opposite to each other in the housing; and a pair of permanent magnets disposed each opposite to the stationary contact and the moving contact;

an arc generated between the stationary contact and the moving contact being drawn due to a current conducting between the stationary contact and the moving contact and a magnetic force of the permanent magnet, wherein an arc shield member is disposed in a position in which an arc in the housing is drawn, wherein the arc shield member has a gate type section including a plate-shaped coupling member and arm portions formed by substantially perpendicularly bending both ends of the coupling member, wherein a partition wall including at least one slit is bridged between outer edge parts of the pair of arm portions.

10. The sealed contact device according to claim 9, wherein at least one arc receiving piece is provided on at least one of edge parts of the coupling member and the arm portion in the arc shield member.

11. The sealed contact device according to claim 9, wherein an upper rib is extended laterally from at least one of upper edge parts of the pair of arm portions.

12. The sealed contact device according to claim 10, wherein an upper rib is extended laterally from at least one of upper edge parts of the pair of arm portions.

* * * * *